US007600292B2

(12) United States Patent
Courtney

(10) Patent No.: US 7,600,292 B2
(45) **Date of Patent: *Oct. 13, 2009**

(54) SURFACE TREATING APPLIANCE

(75) Inventor: Stephen Benjamin Courtney, Bath (GB)

(73) Assignee: Dyson Technology Limited, Wiltshire (GB)

( * ) Notice: Subject to any disclaimer, the term of this patent is extended or adjusted under 35 U.S.C. 154(b) by 722 days.

This patent is subject to a terminal disclaimer.

(21) Appl. No.: 10/523,246

(22) PCT Filed: Jul. 18, 2003

(86) PCT No.: PCT/GB03/03142

§ 371 (c)(1),
(2), (4) Date: Jan. 27, 2005

(87) PCT Pub. No.: WO2004/014211

PCT Pub. Date: Feb. 19, 2004

(65) Prior Publication Data

US 2005/0223517 A1 Oct. 13, 2005

(30) Foreign Application Priority Data

Aug. 9, 2002 (GB) ..... 0218426.5

(51) Int. Cl.
*A47L 9/00* (2006.01)

(52) U.S. Cl. ..... 15/351; 15/410

(58) Field of Classification Search ..... 15/351, 15/352, 353, 414, 339
See application file for complete search history.

(56) References Cited

U.S. PATENT DOCUMENTS

| | | | | |
|---|---|---|---|---|
| 1,689,166 | A | 10/1928 | Varner | |
| 2,162,313 | A | 6/1939 | McCabe et al. | |
| 2,550,384 | A | 4/1951 | Senne | |
| 2,686,330 | A * | 8/1954 | Wales | 15/327.4 |
| 3,150,394 | A | 9/1964 | Saucers | |
| 3,655,005 | A | 4/1972 | Chicurel | |
| 3,794,351 | A | 2/1974 | Cudmore | |
| 4,145,064 | A | 3/1979 | Carn | |

(Continued)

FOREIGN PATENT DOCUMENTS

EP 0 042 723 12/1981

(Continued)

OTHER PUBLICATIONS

GB Search Report, dated Apr. 29, 2003, directed to GB Patent Application No. 0218426.5; 2 pages.

(Continued)

*Primary Examiner*—Lee D Wilson
(74) *Attorney, Agent, or Firm*—Morrison & Foerster LLP

(57) ABSTRACT

A surface treating appliance, such as a vacuum cleaner, includes a handle, a surface treating head and a support assembly. The support assembly is rollably mounted to the main body for allowing the main body to be rolled along a surface. A linkage is provided between the main body and the surface treating head and arranged such that rotating the main body about its longitudinal axis causes the surface treating head to turn in a new direction. The support assembly may house a component of the appliance, such as a motor, and may accommodate a fluid inlet for receiving fluid flow and a fluid outlet for exhausting fluid. The handle may carry the main body of the appliance.

33 Claims, 14 Drawing Sheets

U.S. PATENT DOCUMENTS

| | | | | |
|---|---|---|---|---|
| 4,397,060 | A | 8/1983 | Jinkins et al. | |
| 4,785,899 | A | 11/1988 | von Winckelmann | |
| 5,168,598 | A | 12/1992 | Hashizume et al. | |
| 5,323,510 | A | 6/1994 | Redding et al. | |
| 5,584,095 | A | 12/1996 | Redding et al. | |
| 5,794,305 | A | 8/1998 | Weger | |
| 5,839,156 | A | 11/1998 | Park et al. | |
| 6,141,822 | A | 11/2000 | Riviera-Boklund et al. | |
| 6,277,164 | B1 * | 8/2001 | Embree et al. | 55/374 |
| 6,618,898 | B2 | 9/2003 | Tingle | |
| 6,678,916 | B2 | 1/2004 | Hashizume et al. | |
| 6,684,451 | B2 | 2/2004 | Kato et al. | |
| 6,745,432 | B2 | 6/2004 | Wright et al. | |
| 6,772,474 | B2 * | 8/2004 | Nishikori et al. | 15/359 |
| 6,807,708 | B2 | 10/2004 | Roney et al. | |
| 2002/0129460 | A1 | 9/2002 | Roney et al. | |
| 2003/0084536 | A1 * | 5/2003 | Yung | 15/351 |
| 2003/0188396 | A1 | 10/2003 | Hitzelberger et al. | |
| 2005/0125937 | A1 | 6/2005 | Nielsen | |
| 2005/0223516 | A1 * | 10/2005 | Courtney | 15/351 |
| 2005/0223517 | A1 * | 10/2005 | Courtney | 15/351 |
| 2005/0235454 | A1 * | 10/2005 | Courtney | 15/351 |
| 2008/0022482 | A1 | 1/2008 | Courtney | |

FOREIGN PATENT DOCUMENTS

| | | | |
|---|---|---|---|
| EP | 0353546 | A1 | 2/1990 |
| EP | 1121889 | | 8/2001 |
| EP | 1 129 657 | | 9/2001 |
| EP | 1 136 029 | | 9/2001 |
| FR | 1310618 | | 11/1962 |
| FR | 1333087 | | 7/1963 |
| FR | 2826851 | | 1/2003 |
| GB | 568958 | | 4/1945 |
| JP | S56-009345 | | 6/1979 |
| JP | S61-048328 | | 3/1986 |
| JP | 2001-314356 | | 11/2001 |
| WO | WO-99/30602 | | 6/1999 |
| WO | WO-00/21425 | | 4/2000 |
| WO | WO-01/45545 | | 6/2001 |

OTHER PUBLICATIONS

International Search Report, mailed Nov. 3, 2003, directed to International Patent Application No. PCT/GB2003/003132; 5 pages.
International Preliminary Examination Report, mailed Nov. 9, 2004, directed to International Patent Application No. PCT/GB2003/003132; 8 pages.
Courtney, S.,U.S. Office Action, mailed Jan. 23, 2008, directed to a related U.S. Appl. No. 10/522,339; 11 pages.
Courtney, S.,U.S. Office Action, mailed Sep. 8, 2008, directed to a related U.S. Appl. No. 10/522,339; 9 pages.
Courtney, S.,U.S. Office Action, mailed Apr. 23, 2009, directed to a related U.S. Appl. No. 10/522,339; 6 pages.
Courtney, S.,U.S. Office Action, mailed Mar. 6, 2008, directed to a related U.S. Appl. No. 11/868,809; 10 pages.
Courtney, S.,U.S. Office Action, mailed Nov. 13, 2008, directed to a related U.S. Appl. No. 11/868,809; 9 pages.
International Search Report, mailed Nov. 3, 2003, directed to International Patent Application No. PCT/GB2003/003135; 4 pages.
International Preliminary Examination Report, mailed Oct. 22, 2004, directed to International Patent Application No. PCT/GB2003/003135; 6 pages.
Courtney, S.,U.S. Office Action, mailed Jun. 23, 2008, directed to a related U.S. Appl. No. 10/522,478; 12 pages.
Courtney, S.,U.S. Office Action, mailed Jan. 6, 2009, directed to a related U.S. Appl. No. 10/522,478; 5 pages.
Courtney, S.,U.S. Office Action, mailed Mar. 23, 2009, directed to a related U.S. Appl. No. 10/522,478; 6 pages.
International Search Report, mailed Apr. 11, 2003, directed to International Patent Application No. PCT/GB2003/003142; 4 pages.
International Preliminary Examination Report, mailed Oct. 22, 2004, directed to International Patent Application No. PCT/GB2003/003142; 8 pages.
Courtney, U.S. Office Action mailed May 26, 2009, directed to U.S. Appl. No. 10/522,478; (5 pages).

* cited by examiner

SURFACE TREATING APPLIANCE

FIELD OF THE INVENTION

This invention relates to a surface treating appliance, such as a vacuum cleaner.

BACKGROUND OF THE INVENTION

Surface treating appliances such as vacuum cleaners and floor polishers are well known. The majority of vacuum cleaners are either of the 'upright' type or of the 'cylinder' type, called canister or barrel cleaners in some countries. An example of an upright vacuum cleaner manufactured by Dyson Limited under the name DC04 ("DC04" is a trade mark of Dyson Limited) is shown in FIG. 1. The vacuum cleaner comprises a main body 102 which houses the main components of the vacuum cleaner. A lower part 106 of the main body houses a motor and fan for drawing dirty air into the machine and the main body also houses some form of separating apparatus 104 for separating dirt, dust and other debris from a dirty airflow drawn in by the fan. The main body 102 also houses filters for trapping fine particles in the cleaned airflow. A cleaner head 108 is rotatably mounted, about points A, to the lower end of the main body 102. The axis about which the cleaner head rotates is horizontally directed. A supporting wheel 107 is mounted on each side of the lower part 106 of the main body, in a fixed relationship to the main body 102. In use, a user reclines the main body 102 of the vacuum cleaner and then pushes and pulls a handle 116 which is fixed to the main body of the cleaner. The vacuum cleaner rolls along the floor surface on the supporting wheels 107.

A dirty-air inlet 112 is located on the underside of the cleaner head 108. Dirty air is drawn into the dust separating apparatus 104 via the dirty-air inlet 112 by means of the motor-driven fan. It is conducted to the dust separating apparatus 104 by a first air flow duct. When the dirt and dust entrained within the air has been separated from the airflow in the separating apparatus 104, air is conducted to the clean air outlet by a second air flow duct, and via one or more filters, and expelled into the atmosphere.

Conventional upright vacuum cleaners have a disadvantage in that they can be difficult to manoeuvre about an area in which they are used. They can be pushed and pulled easily enough, but pointing the cleaner in a new direction is more difficult. The cleaner can be pointed in a new direction by applying a sideways directed force to the handle, either from standstill or while moving the cleaner forwards or backwards. This causes the cleaner head to be dragged across the floor surface so that it points in a new direction. The only articulation between the main body 102 and the cleaner head 108 is about horizontally directed axis A, which remains parallel with the floor surface. In some upright vacuum cleaners the supporting wheels 107 are mounted on the cleaner head rather than the main body. However, the main body is rotatably mounted to the cleaner head about a horizontally directed axis, as just described.

Attempts have been made to increase the manoeuvrability of upright vacuum cleaners. Some examples of upright vacuum cleaners with improved manoeuvrability are shown in U.S. Pat. Nos. 5,323,510 and 5,584,095. In both of these documents, the vacuum cleaners have a base which includes a motor housing and a pair of wheels, and the connection between the base and the main body incorporates a universal joint which permits rotational movement of the main body with respect to the base about an axis which is oriented perpendicular to the rotational axis of the wheels and inclined with respect to the horizontal.

A further, less common, type of vacuum cleaner is a 'stick vac', which is so-called because it has a very slender stick-like main body. An example is shown in EP 1,136,029. Often, there is only a cleaner head at the base of the machine, with all other components of the machine being incorporated in the main body. While stick vacs are lighter weight and can be easier to manoeuvre than traditional upright cleaners, they generally have a small dust separator, a lower power motor and smaller filters, if any filters at all, and thus their improved manoeuvrability comes with the drawback of a lower specification.

SUMMARY OF THE INVENTION

The present invention seeks to provide a surface treating appliance with improved manoeuvrability.

The invention provides a surface treating appliance comprising a handle having a longitudinal axis, a surface treating head, a support assembly which is attached to the handle and arranged to roll with respect to the handle for allowing the appliance to be rolled along a surface, and a linkage between the handle and the surface treating head, the linkage being arranged such that rotating the support assembly and the handle about the longitudinal axis causes the surface treating head to turn in a new direction.

The provision of a rolling support surface and a linkage which allows the handle to be rotated or twisted about its longitudinal axis, in the manner of a corkscrew, improves manoeuvrability and ensures a smooth transition between the forward running and turning positions. Thus, the usability of the appliance is improved.

Preferably a joint is provided between the handle and the cleaner head, which joint may be lockable in order to prevent the cleaner head from turning when the appliance is in an upright position. This feature provides stability to the appliance when it is stationary.

The main body of the appliance may be carried on the handle, as in an upright vacuum cleaner or stick vac. Alternatively, the main body may be located elsewhere and the invention may be used in the manner of a floor tool.

Advantageously, the support assembly is arranged so that the diameter of the central portion is greater than that of the end portions, so that the outer surface has a spherical or barrel shape. This greater facilitates the user in turning the appliance in a new direction. The support assembly may house one or more components of the appliance.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

BRIEF DESCRIPTION OF THE DRAWINGS

Embodiments of the invention will now be described with reference to the drawings, in which.

DETAILED DESCRIPTION OF THE INVENTION

FIGS. 3-13 show a first embodiment of a vacuum cleaner 200 with a main body 210, a roller assembly 220 and a cleaner head 230.

Figure 6:
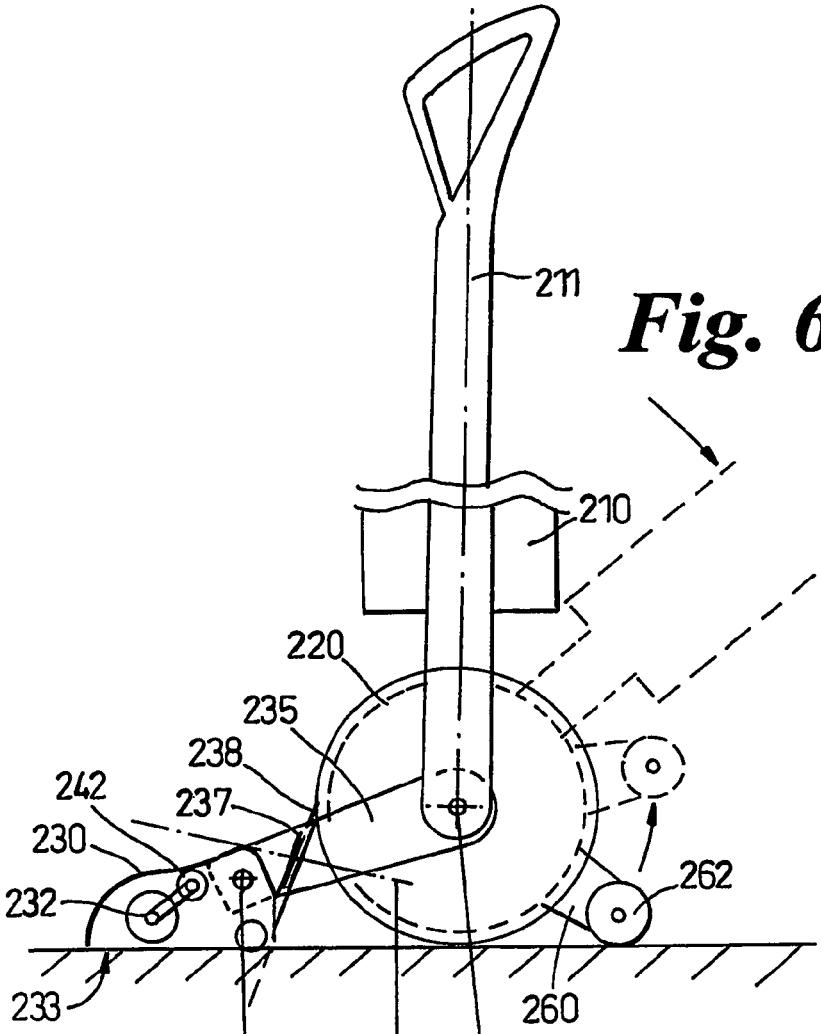
FIGS. 6 and 7 show the connection between the cleaner head and main body of the vacuum cleaner of FIGS. 3 to 5.

The cleaner head 230, as in a conventional upright vacuum cleaner, serves to treat the floor surface. In this embodiment, it comprises a housing with a chamber for supporting a brush bar 232 (FIG. 6). The lower, floor-facing side of chamber has an air inlet slot 233 and the brush bar 232 is rotatably mounted in the chamber such that bristles on the brush bar 232 can protrude through the inlet slot 233 and can agitate the floor surface over which the cleaner head 230 passes. The brush bar 232 is rotatably driven by a dedicated motor 242 positioned on the cleaner head 230. A drive belt connects the motor 242 to the brush bar 232. This avoids the need to provide a driving connection between the suction fan and the brush bar. However, it will be appreciated that the brush bar can be driven in other ways, such as by a turbine which is driven by incoming or exhaust airflow, or by a coupling to the motor which is also used to drive the suction fan. The coupling between the motor and brush bar can alternatively be via a geared coupling. In alternative embodiments the brush bar can be removed entirely so that the machine relies entirely on suction or by some other form of agitation of the surface. For other types of surface treating machines, the cleaner head 230 can include appropriate means for treating the floor surface, such as a polishing pad, a liquid or wax dispensing nozzle etc. The lower face of the cleaner head 230 can include small rollers to ease movement across a surface.

The cleaner head 230 is connected to the main body 210 of the vacuum cleaner in such a manner that the cleaner head 230 remains in contact with a floor surface as the main body is manoeuvred through a wide range of operating positions, e.g. when moved from side-to-side or when the main body 210 is twisted about its longitudinal axis 211. A yoke 235 connects the main body 210 to the cleaner head 230 in a manner which will be described in more detail below.

Figure 13:
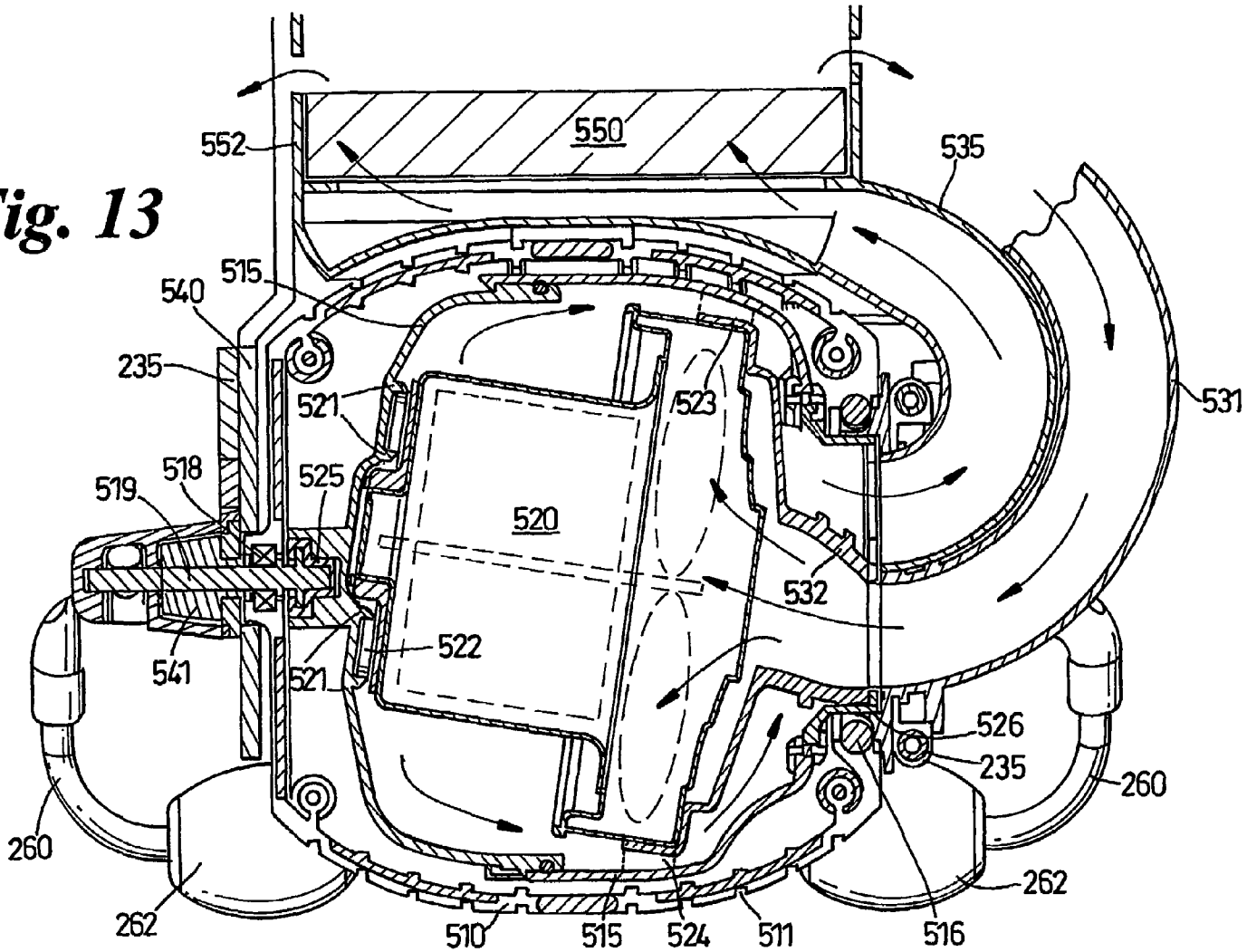
FIG. 13 shows a cross-sectional view through the roller assembly of the vacuum cleaner.

The main body 210 is rotatably connected to a roller assembly 220, which lies at the base of the main body 210. The roller assembly 220 allows the apparatus to be easily pushed or pulled along a surface. The shape of the roller assembly 220 and the connections between the main body 210 and the roller assembly 220, and the roller assembly 220 and the cleaner head 230, allow the apparatus to be more easily manoeuvred than traditional vacuum cleaners. On the left hand side the mechanical connection between the main body 210 and the roller assembly 220 is by an arm 540 which extends downwardly from the base of the main body 210. As shown in more detail in FIG. 13, arm 540 includes a sleeve 541 for receiving a shaft 519 on which the roller shell 510 is rotatably mounted. On the right hand side of the machine, the connection between the main body 210 and the roller assembly 220 is by the flow ducts 531, 535, as best seen in FIG. 13.

The main body 210 has a handle 212 which extends upwardly from the top of the main body 210. The handle has a gripping section 213 by which a user can comfortably grip the handle and manoeuvre the apparatus. The gripping section can simply be a part of the handle which is specially shaped or treated (e.g. rubberised) to make it easy to grasp, or it can be an additional part which is joined to the handle at an angle to the longitudinal axis of the handle, as shown in FIGS. 3-6.

Figure 8:
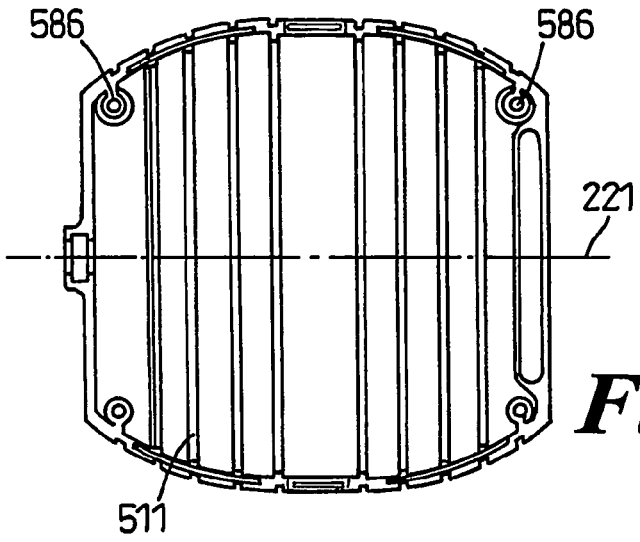
FIGS. 8-10 show the roller assembly of the vacuum cleaner.
Figure 9:
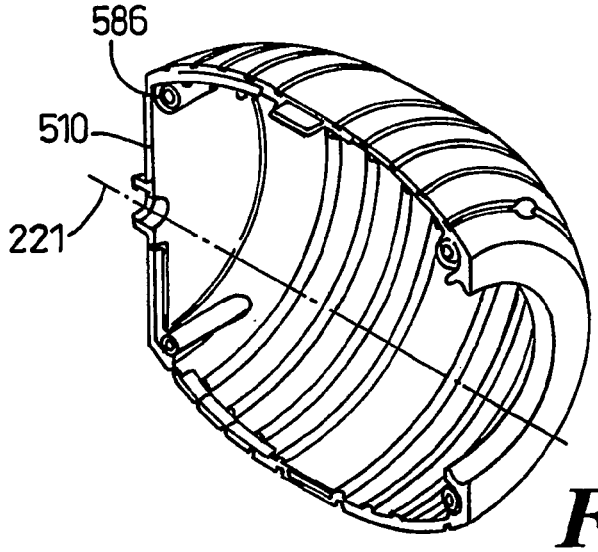
Figure 10:
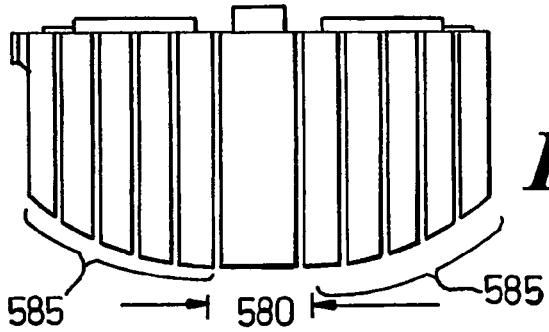

The outer shell 510 of the roller assembly 220 is shown in more detail in FIGS. 8-10. Conveniently, the outer shell 510 comprises two halves, one of which is shown in FIG. 9, which can be secured together by fixings which locate in bores 586. In this embodiment, the overall shape of the roller 220 resembles a barrel. Looking at the shape of the outer surface in the direction along the longitudinal axis, there is a generally flat central region 580 and an arcuate region 585 at each end where the diameter, or width, of the shell 510 decreases. The central, flat region 580 has a constant diameter and extends for around 25% of the total length of the roller assembly. We have found that a flat central region aids a user in steering the machine along a straight line, since the machine will naturally run straight and is less likely to wobble during backwards movements. The width of the central region can be increased or decreased as desired while still obtaining the benefit of the invention. The arcuate outer regions 585 allow the main body to roll towards one side when a user wishes to steer the machine in a different direction. Ridges 511 are provided on the outer surface of the roller shell 510 to improve grip over surfaces. It is also beneficial to provide a non-slip texture or coating on the outermost surface of the roller shell 510 to aid grip on slippery surfaces such as hard, shiny or wet floors. The length of the roller assembly is substantially equal to the width of the main body 210 of the vacuum cleaner. The provision of a continuous support surface across the width of the machine provides a reassuringly supportive feel to a user as the machine is manoeuvred through a wide range of operating positions. Alternatives to this shape of roller assembly are discussed later.

Figure 11:
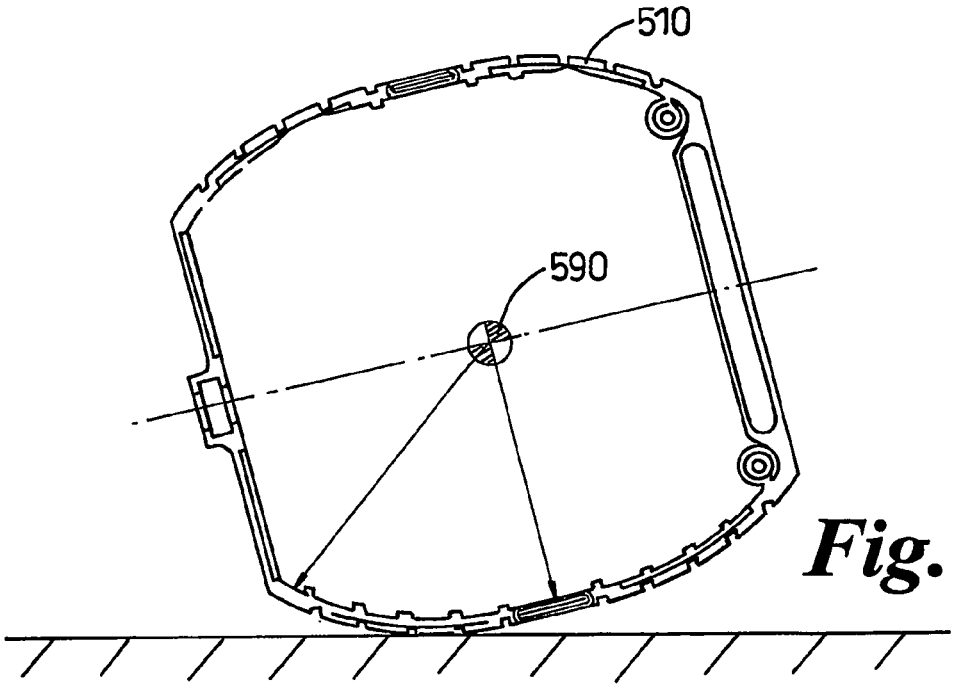
FIGS. 11 and 12 show the roller assembly in use.
Figure 12:
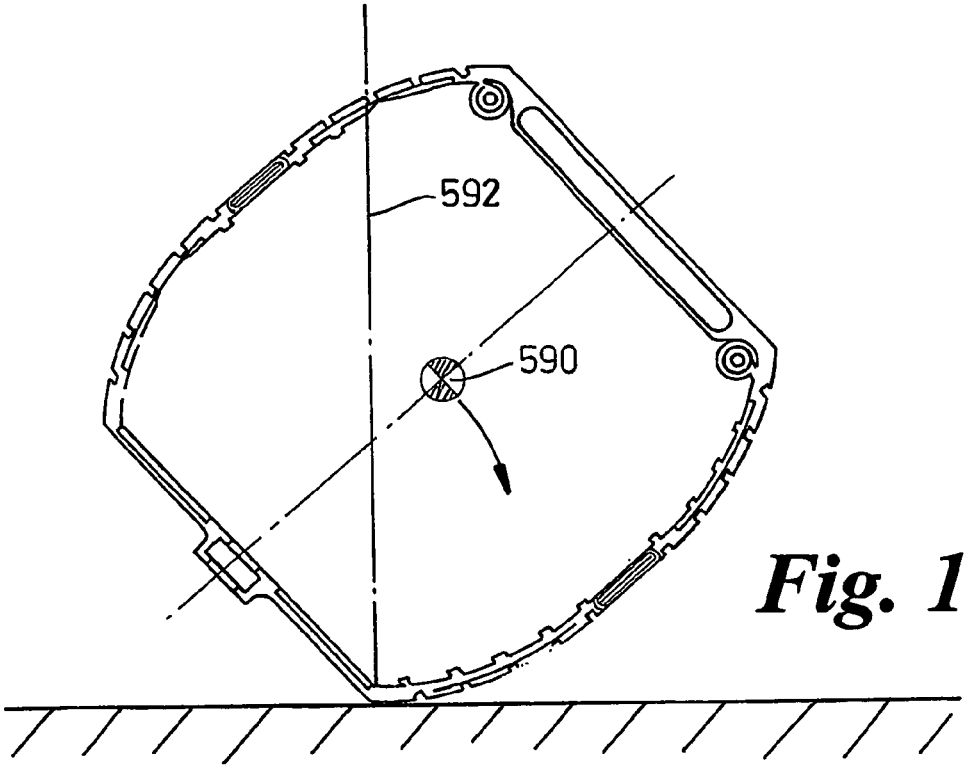

Referring to FIG. 11, the shape of the roller surface is chosen such that the centre of mass 590 of the roller assembly always remains in a position in which it serves to right the machine. To demonstrate this, FIG. 12 shows that even when the roller is turned onto its outermost edge, the centre of mass 590 will still lie to the right of a line 592 drawn perpendicular to the surface, and thus the roller assembly will have a tendency to return to a stable position.

The shape of the arcuate region 585 of the roller surface is also selected such that the distance between the centre of mass 590 of the roller assembly and a point on the surface of the roller shell increases as one moves along the arcuate surface away from the central region 580. The effect of this shape is that it requires an increasingly greater force to turn the roller, as the roller is turned further from the normal straight running position. The diameter of the roller shell 510 at each end of its longitudinal axis determines the extent to which the main body can roll to one side. This is chosen such that there will be sufficient clearance between the main body—and particularly the ducts 531, 535 at the point at which they enter the roller assembly—and the floor surface in this most extreme position.

Figure 7:
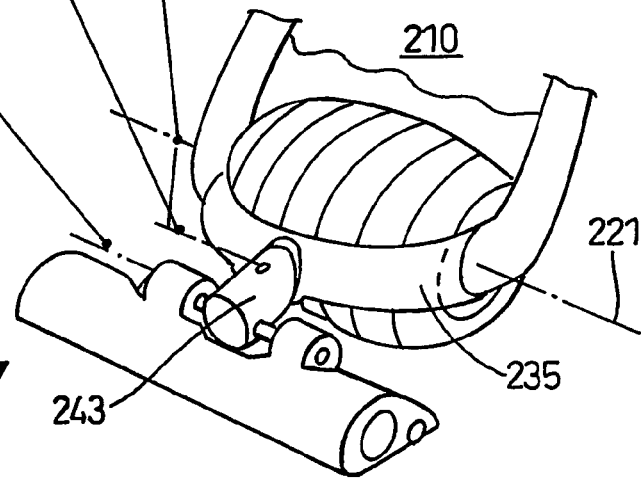

The mechanical connection between the main body 210 and the cleaner head 230 is shown in FIGS. 6 and 7. In this embodiment, the connection between the main body 210 and the cleaner head 230 takes the form of a yoke 235 which is mounted to each end of the rotational axis 221 of the roller assembly 220. Further detail of the connection is shown in FIG. 13. The yoke 235 can rotate independently of the main body 210. At the forward, central part of the yoke 235 there is a joint 237 with an arm 243. Arm 243 joins the yoke 235 to the cleaner head 230. The other end of arm 243 is pivotably mounted to the cleaner head 230 about pivot 241. The joint 237 is of the type where the respective pipes can slide against one another. The plane of this jointed connection 237 is shown by line 238. The plane 238 of the joint is formed at a non-normal angle to the longitudinal axis of the arm 243. We have found that an angle which is substantially perpendicular to the floor surface (when the machine is in the forward running position), or further inclined from this position to what is shown in FIG. 6, works well. As arm 243 also carries airflow from the cleaner head 230, the joint 237 maintains an airtight seal as arm 243 moves with respect to yoke 235.

Figure 1:
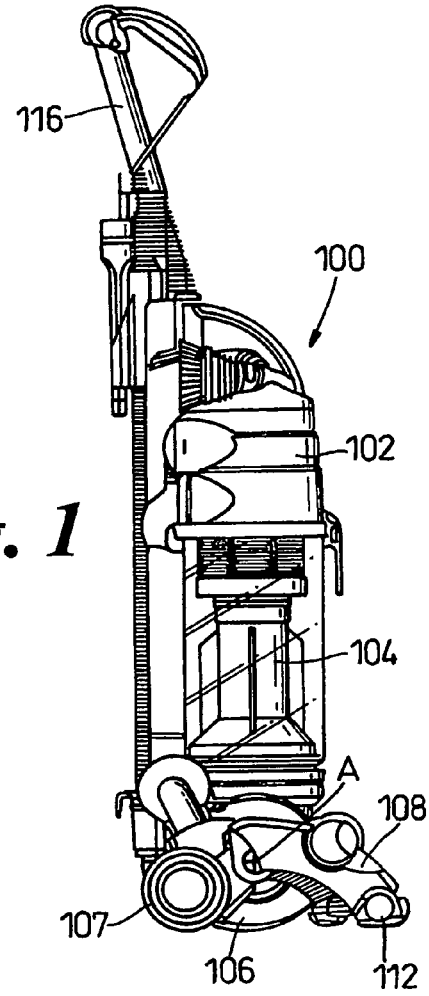
FIGS. 1 and 2 show a known type of vacuum cleaner.
Figure 2:
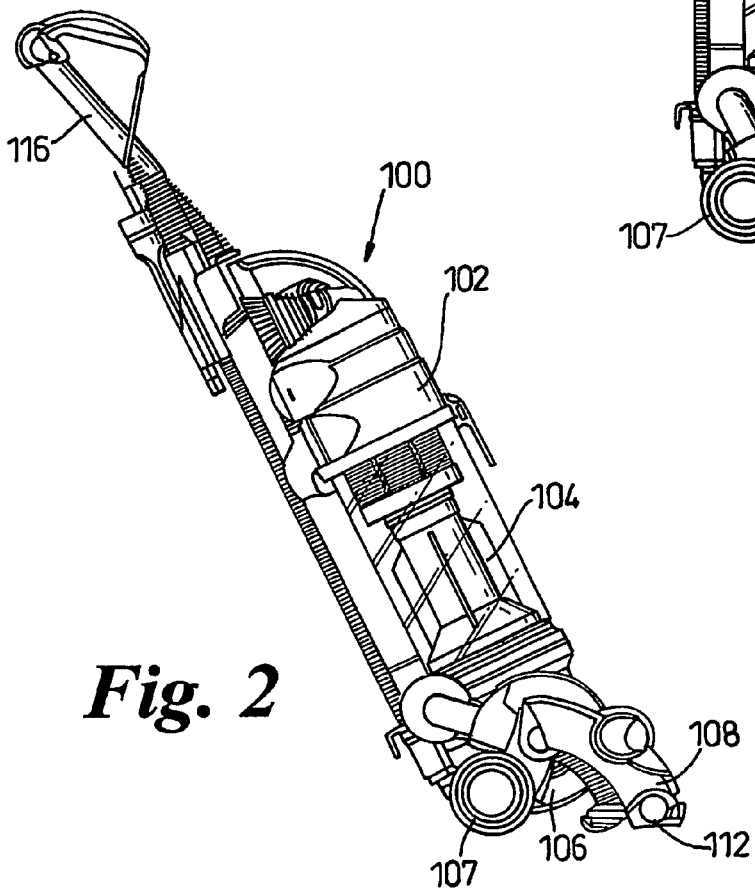
Figure 3:
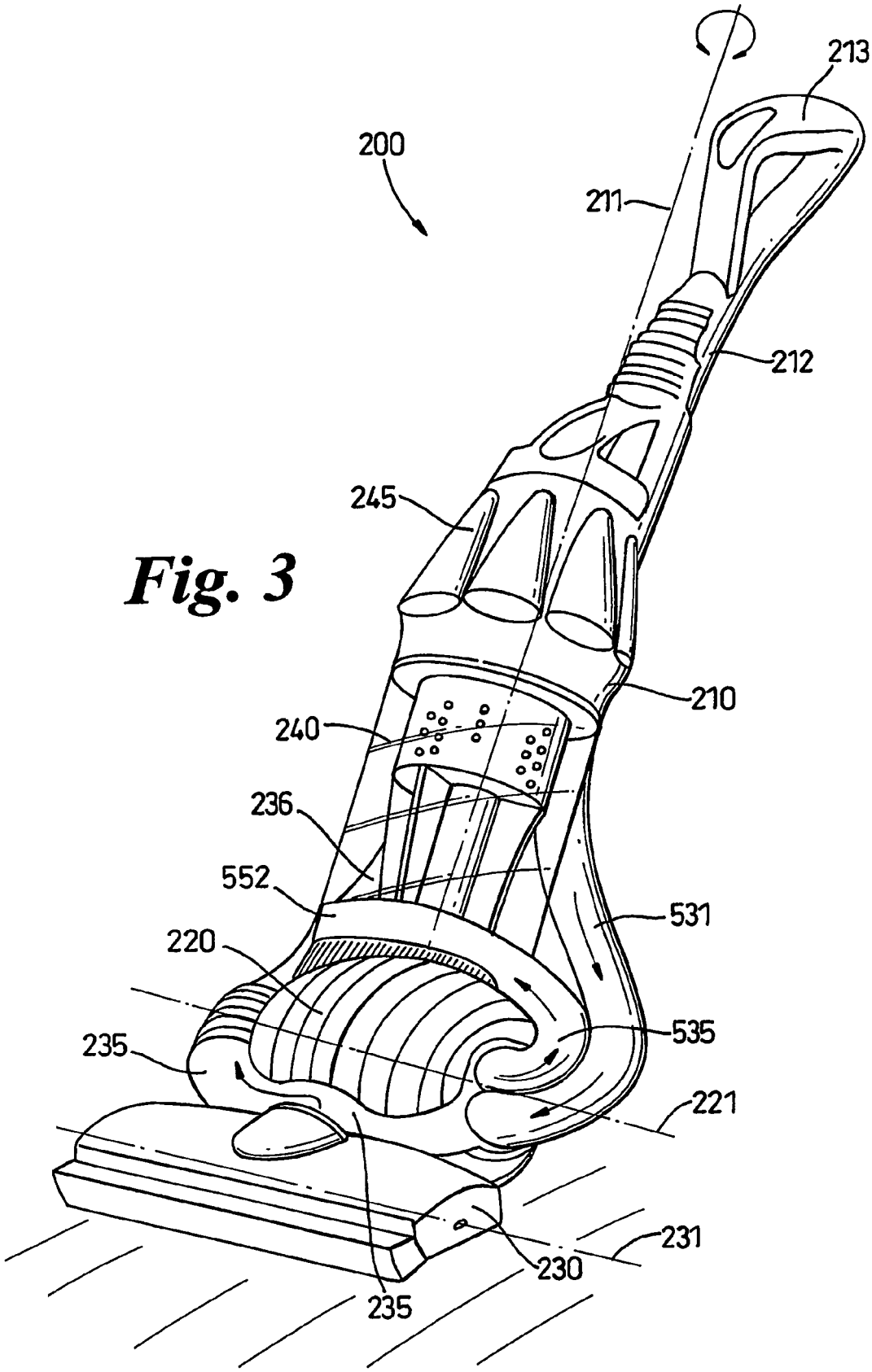
FIG. 3 shows a vacuum cleaner in accordance with an embodiment of the invention.
Figure 4:
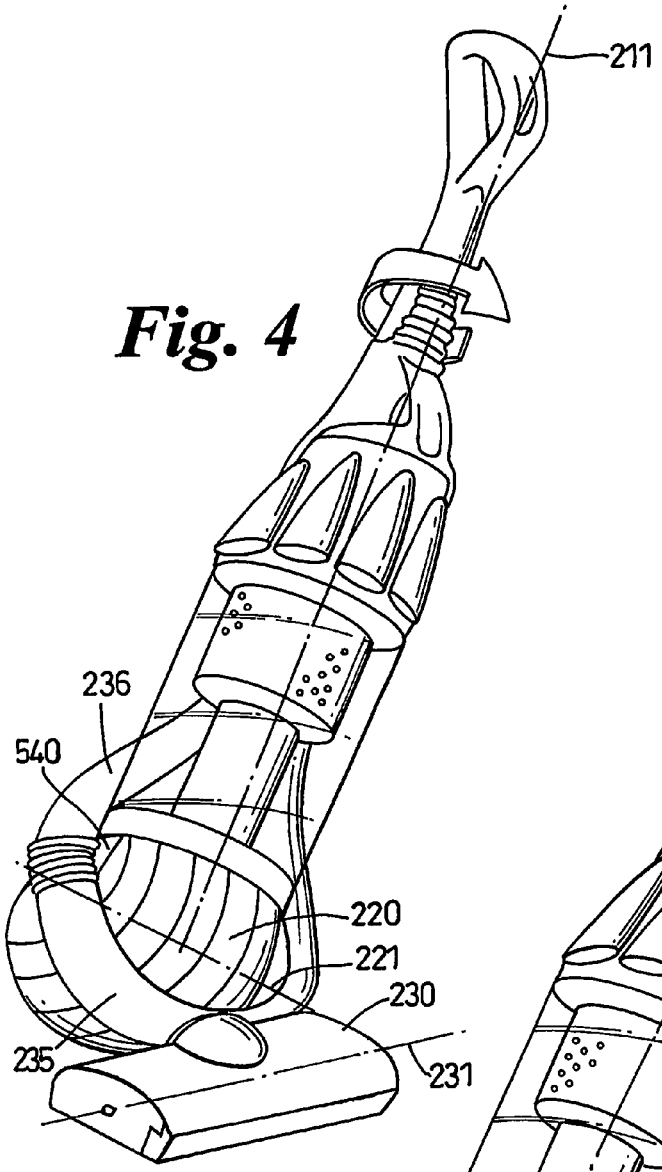
FIGS. 4 and 5 show the vacuum cleaner of FIG. 3 in use.
Figure 5:
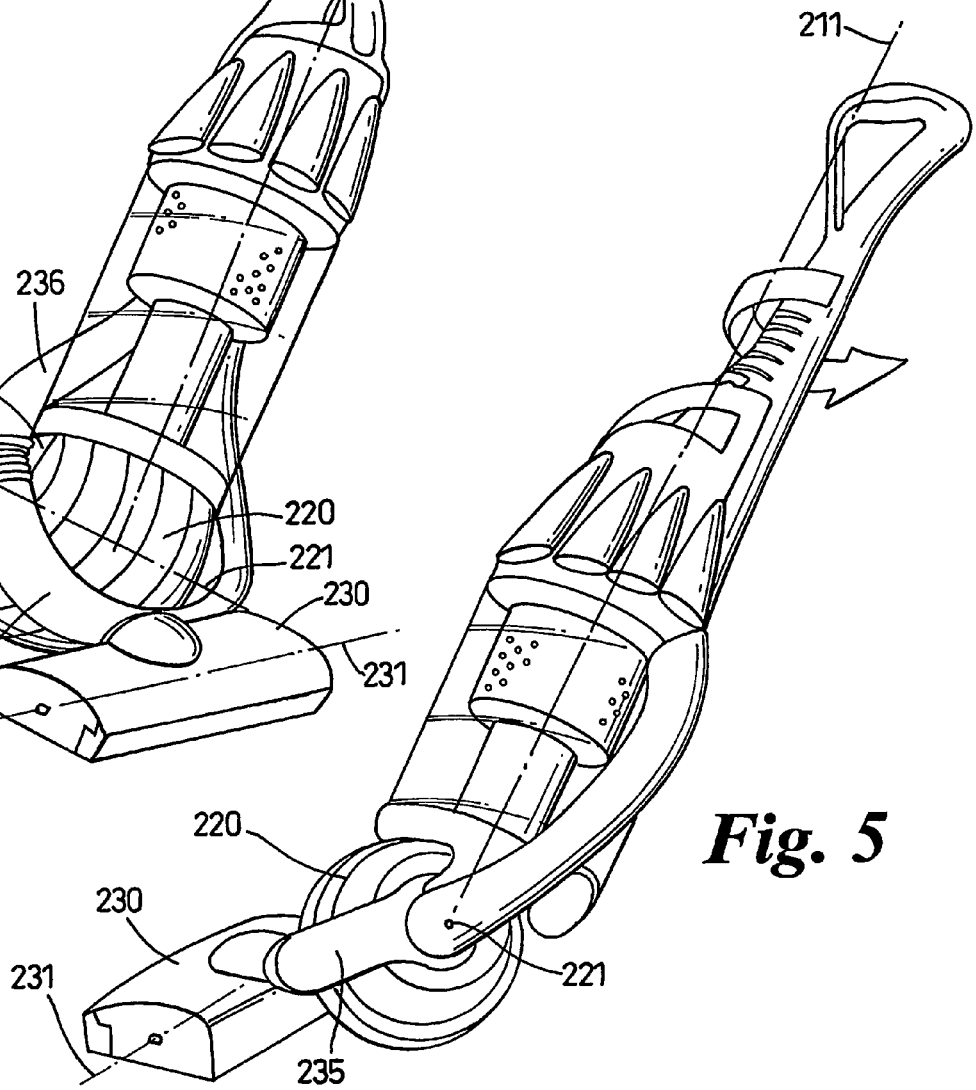

This arrangement of the pivotal mounting 241 of the yoke 235 and joint 237, allows the main body 210 together with the roller assembly 220 to be rotated about its longitudinal axis 211, in the manner of a corkscrew, while the cleaner head 230 remains in contact with the floor surface. This arrangement also causes the cleaner head 230 to point in a new direction as the main body is rotated about its longitudinal axis 211. FIG. 3 shows the position for forward or backward movement in a straight line while FIGS. 4 and 5 show the vacuum cleaner in two different turning positions. In FIG. 3 the main body 210 is reclined into an operating position. The longitudinal axis 221 of the roller assembly 220 is parallel with the floor and with the longitudinal axis 231 of the cleaner head 230. Thus, the cleaner moves in a straight line. The main body can be moved anywhere between a fully upright position, in which the longitudinal axis 211 of the main body is perpendicular to the floor surface, and a fully reclined position in which the longitudinal axis 211 of the main body lies substantially parallel to the floor surface.

FIG. 4 shows the vacuum cleaner turning towards the left. The main body 210 is rotated anti-clockwise about its longitudinal axis 211. This raises the longitudinal axis 221 of the roller 220 assembly into a position which is inclined with respect to the floor and which is facing towards the left compared to the starting, straight running, position. The inclined joint 237 between the main body 210 and cleaner head 230 causes the cleaner head 230 to point towards the left. The pivotable connections between the yoke 235 and the main body 210, and between the arm 243 and the cleaner head 230, allow the cleaner head to remain in contact with the floor, even though the height of the yoke 235 varies as the main body is rotated. The arcuate region 585 of the roller allows the body to roll into this position, while still providing support for the main body 210. The extent to which the main body 210 is turned in the anti-clockwise direction determines the extent to which the cleaner head 230 moves from its forward facing position towards the left. The smaller diameter part 585 of the roller assembly not only allows the main body to roll onto one side, but tightens the turning circle of the vacuum cleaner.

FIG. 5 shows the vacuum cleaner turning towards the right. This is the opposite to what was just described for turning to the left. The main body 210 is rotated clockwise about its longitudinal axis 211. This raises the longitudinal axis 221 of the roller assembly 220 into a position which is inclined with respect to the floor and which is facing towards the right compared to the starting, straight running, position. The joint 237 between the main body 210 and cleaner head 230 causes the cleaner head 230 to point towards the right, while still remaining in contact with the floor. The arcuate region 585 of the roller allows the body to roll into this position, while still providing support for the main body 210. The extent to which the main body 210 is turned in the clockwise direction determines the extent to which the cleaner head 230 moves from its forward facing position towards the right.

The main body 210 houses separating apparatus 240, 245 which serves to remove dirt, dust and/or other debris from a dirty airflow which is drawn in by the fan and motor on the machine. The separating apparatus can take many forms. We prefer to use cyclonic separating apparatus in which the dirt and dust is spun from the airflow of the type described more fully in, for example, EP 0 042 723.

The cyclonic separating apparatus can comprise two stages of cyclone separation arranged in series with one another. The first stage 240 is a cylindrical-walled chamber and the second stage 245 is a tapering, substantially frusto-conically shaped, chamber or a set of these tapering chambers arranged in parallel with one another. In FIG. 3, airflow is directed tangentially into the upper part of a first cyclonic chamber 240 by duct 236. Larger debris and particles are removed and collected in the first cyclonic chamber. The airflow then passes through a shroud to a set of smaller frusto-conically shaped cyclonic chambers. Finer dust is separated by these chambers and the separated dust is collected in a common collecting region. The second set of separators can be upright, i.e. with their fluid inlets and outlets at the top and their dirt outlets at the bottom, or inverted, i.e. with their fluid inlets and outlets at the bottom and their dirt outlets at the top. However, the nature of the dust separating apparatus is not material to the present invention and the separation of dust from the airflow could equally be carried out using other means such as a conventional bag-type filter, a porous box filter, an electrostatic separator or some other form of separating apparatus. For embodiments of the apparatus which are not vacuum cleaners, the main body can house equipment which is appropriate to the task performed by the machine. For example, for a floor polishing machine the main body can house a tank for storing liquid wax.

A fan and a motor for driving the fan, which together generate suction for drawing air into the apparatus, are housed in a chamber mounted inside the roller assembly 220.

A number of airflow ducts carry airflow around the machine. Firstly, an airflow duct connects the cleaner head 230 to the main body of the vacuum cleaner. This airflow duct is located within the left hand arm (FIG. 3) of yoke 235. Another duct 236 carries the dirty airflow from the yoke 235 to separating apparatus 240 on the main body. A changeover mechanism is provided for selecting whether airflow from the yoke 235, or a separate hose on the machine, is carried to the separating apparatus 240. A suitable mechanism of this type is described more fully in our International Application WO 00/21425.

Another airflow duct 531 connects the outlet of the separating apparatus 245 to the fan and motor, within the roller assembly 220, and a further airflow duct 535 connects the outlet of the fan and motor to a post motor filter on the main body 210.

One or more filters are positioned in the airflow path downstream of the separating apparatus 240, 245. These filters remove any fine particles of dust which have not already been removed from the airflow by the separating apparatus 240, 245. We prefer to provide a first filter, called a pre-motor filter, before the motor and fan 520, and a second filter 550, called a post-motor filter, after the motor and fan 520. Where the motor for driving the suction fan has carbon brushes, the post-motor filter 520 also serves to trap any carbon particles emitted by the brushes.

Filter assemblies generally comprise at least one filter located in a filter housing. Commonly, two or three filters are arranged in series in the filter assembly to maximise the amount of dust captured by the filter assembly. One known type of filter comprises a foam filter which is located directly in the air stream and has a large dust retaining capacity. An electrostatic or HEPA grade filter, which is capable of trapping very small dust particles, such as particles of less than one micron, is then provided downstream of the foam filter to retain any dust which escapes from the foam filter. In such a known arrangement, little or no dust is able to exit the filter assembly. Examples of suitable filters are shown in our International Patent Application numbers WO 99/30602 and WO 01/45545.

In this embodiment, the filter or filters are both mounted in the main body 210.

FIG. 13 shows a detailed cross-section through the roller assembly 220. The outer shell 510, which has previously been shown in FIGS. 8-10, is mounted such that it can rotate with respect to the main body 210. The main components within the roller shell 510 are a motor bucket 515 and a fan and motor unit 520. On the left hand side, a support arm 540 extends down from the main body 210 alongside the end face of the roller shell. A shaft 519 passes through a hole in the centre of the end face of the roller shell 510. Shaft 519 is supported by a sleeve in part 541 of arm 540. The roller shell 510 is rotatably supported on the shaft 519 by bearings 518. The shaft 519 extends along the longitudinal axis (and rotational axis) of the roller shell 510 to locate within a pocket 525 on the end face of the motor bucket 515. On the right hand side of the machine, the roller shell 510 has a much larger opening in its side face so as to accommodate inlet 531 and outlet 535 ducts. The inlet and outlet ducts 531, 535 serve a number of purposes. They provide support both for the roller shell 510 and the motor bucket 515 and they duct air into/out of the motor bucket 515. The roller shell 510 is rotatably supported on the motor bucket 515 by bearings 516. The motor bucket 515 is mounted in a fixed relationship to the main body 210 and support ducts, i.e. the motor bucket 515 moves with the main body and the support ducts while the roller shell 510 can rotate around the motor bucket 515 when the machine is moved along a surface. The motor bucket 515 fixes to the ducts 531, 535 by part 526. Ducts 531 and 535 communicate with the interior of the motor bucket 515. Duct 531 delivers airflow from the separating apparatus 240, 245 on the main body 210 directly to the inside of the motor bucket 515. Mounting the fan and motor unit within the motor bucket 515 helps to reduce noise since the motor bucket 515 and the roller shell 510 form a double-skinned housing for the fan and motor unit 520, with an air gap between the skins 510, 515.

The fan and motor unit 520 is mounted within the motor bucket 515 at an angle to the longitudinal axis of the motor bucket 515 and the roller shell 510. This serves two purposes: firstly, it distributes the weight of the motor 520 evenly about the centre of the roller shell, i.e. the centre of gravity of the fan and motor unit is aligned with the centre of the gravity of the overall roller assembly, and secondly, it improves the airflow path from inlet duct 531 into the fan and motor unit 520. The fan and motor unit 520 is supported within the motor bucket 515 by fixings at each end of its longitudinal axis. At the left hand side, the cavity between outwardly extending ribs 521 receives part 522 of the motor. On the right hand side, an outwardly tapering funnel 532 joins inlet duct 531 to the inlet of the fan and motor unit 520. The downstream end of the funnel 532 has a flange 523 which fits around the fan and motor unit 520 to support the fan and motor unit 520. Further support is provided by a web 524 which surrounds the fan and motor unit 520 and fits between flange 523 and the inner face of the motor bucket 515. The funnel 532 also ensures that incoming and outgoing airflows from the motor bucket are separated from one another.

Air is carried to the fan and motor unit 520 within the roller assembly by inlet duct 531 and funnel 532. Once airflow has passed through the fan and motor unit 520, it is collected and channelled by the motor bucket 515 towards the outlet duct 535. Outlet duct 535 carries the airflow to the main body 210.

Outlet duct 535 connects to the lower part of the main body 210. Part 552 of the main body is a filter housing for the post motor filter 550. Air from duct 535 is carried to the lower face of the filter housing, passes through filter 550 itself, and can then exhaust to atmosphere through venting apertures on the filter housing 552. The venting apertures are distributed around the filter housing 552.

A stand assembly 260, 262 is provided on the machine to provide support when the machine is left in an upright position. The stand assembly is arranged so that it is automatically deployed when the main body 210 is brought towards the fully upright position, and is retracted when the main body 210 is reclined from the fully upright position.

There is a wide range of alternative configurations to what has just been described and a number of these will now be described.

Figure 14:
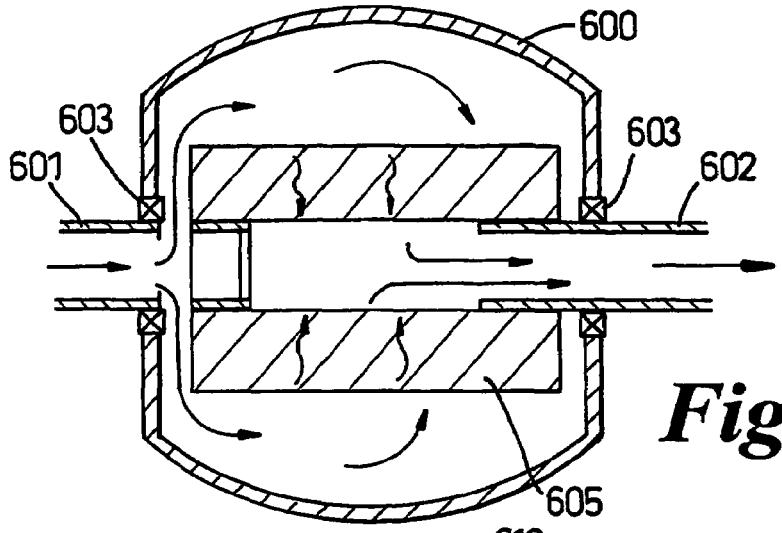
FIGS. 14-16 show ways of housing a filter within the roller assembly.
Figure 15:
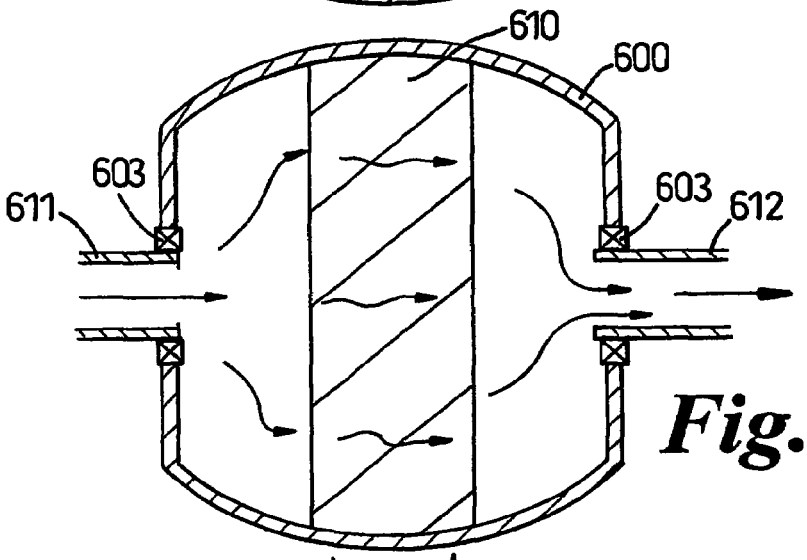
Figure 16:
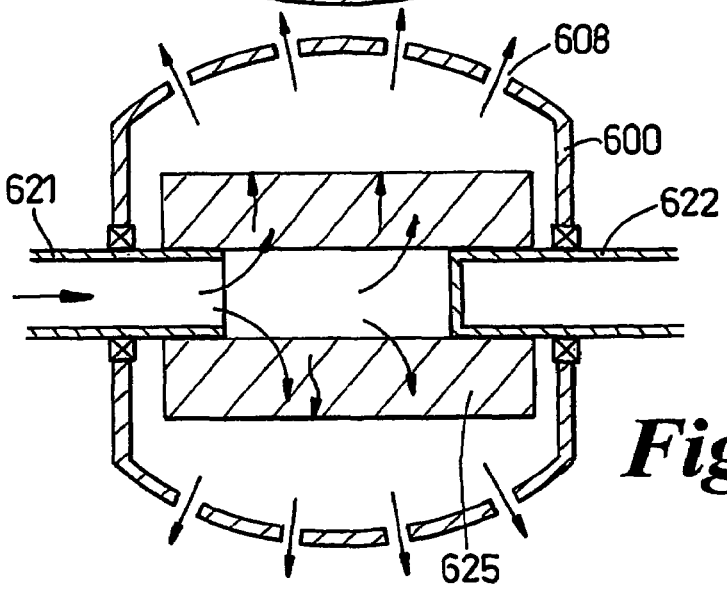

In the embodiment just described, airflow is ducted into and out of the roller shell 510, from one side of the roller shell, and the space within the roller shell 510 is used to house a motor bucket 515 and the fan and motor unit 520. Other uses can be made of the space inside the roller shell 510 and FIGS. 14-16 show some of these alternatives. In each of FIGS. 14-16 a filter is housed within the roller shell 600. In FIG. 14 a cylindrical filter assembly 605 is housed within the roller shell 600 with its longitudinal axis aligned with that of the roller shell. An inlet airflow duct 601 carries air from the outlet of the separating apparatus 240, 245 on the main body 210 of the vacuum cleaner to the interior of the roller shell 600. An outlet airflow duct 602 carries airflow from the interior of the roller shell 600. The roller shell is rotatably mounted about ducts 601, 602 on bearings 603. Filter 605 is supported by the ducts 601, 602. In use, air flows from inlet duct 601, around the outside of filter 605 and radially inwards, through the filter medium, to the central core of the filter 605. The air can then flow along the core and exit the roller shell 600 via outlet duct 602.

In FIG. 15, a filter 610 is mounted transversely across the roller shell 600. The inner surface of the roller shell 610 can be provided with suitable fixings for securing the filter 610 in place. The air flow in FIG. 15 is much simpler. Air flows from inlet duct 611, through the interior of the roller shell 600, through filter medium 610 and then leaves the roller shell via outlet duct 612. The filter material can include foam and filter paper which is either flat or pleated to increase the surface area of filter medium presented to the airflow.

FIG. 16 is similar to FIG. 14 in that a filter 625 is mounted with its longitudinal axis aligned with that of the roller shell 600. The notable difference is that air can exhaust directly to atmosphere from via apertures 608 in the roller shell 600. Duct 622 provides mechanical support for the roller shell and does not carry airflow.

To gain access to the filter a hatch can be provided in the roller shell 600. However, as many filters are now lifetime filters, which do not require changing during the normal lifetime of the machine, it can be acceptable to fit the filter within the roller shell in a less accessible manner.

In each of these embodiments it is possible to provide an inner shell within the roller shell 600, in the same manner as motor bucket 515 was provided in FIG. 13. The inner shell will be sealed to the inlet and outlet ducts, thus alleviating the sealing requirements of the roller shell.

In FIGS. 14 and 15 the exhaust duct can be mounted on the same side of the roller assembly as the inlet duct. The two ducts can be mounted in a side-by-side relationship, as previously shown in FIG. 13, or one duct can surround the other duct, as shown later in FIG. 18.

Figure 17:
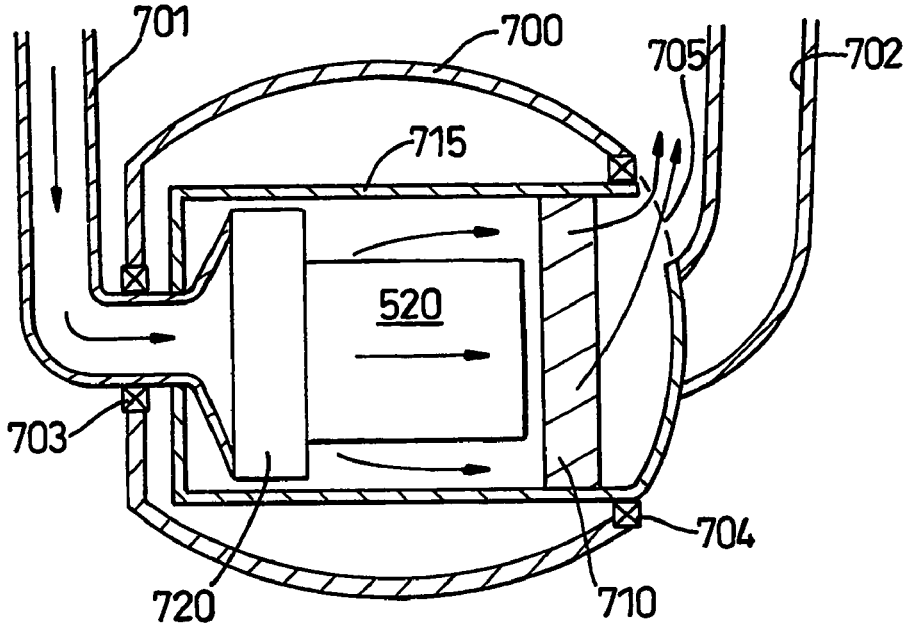
FIG. 17 shows an alternative way of housing a motor and filter within the roller assembly.

FIG. 17 shows an alternative arrangement for mounting a fan and motor unit inside the roller assembly. As with the arrangement shown in FIG. 13, there is a roller shell 700 with a motor bucket 715 mounted inside, and the roller shell 700 can rotate around the motor bucket 715. An inlet airflow duct carries air to the fan and motor unit 520. However, in this embodiment, a filter 710 is positioned downstream of the fan and motor, inside motor bucket 715. Air is exhausted directly from the roller assembly via an outlet 705. The outlet 705 is positioned next to the support arm 702 on the hub of roller 700. This means that air outlet 705 remains stationary as the roller 700 rotates. As a further alternative, the filter 710 could be omitted altogether. Where the motor is a brushless motor, such as a switched reluctance motor, there will not be any carbon emissions from the motor and thus there is less need for a post-motor filter. When air is directly exhausted from the roller assembly in this manner there is an option of still providing the second support arm 702 (which does not carry airflow), or the second support arm 702 can simply be omitted and all of the support for the roller assembly is provided by the first support arm.

Alternatively, or additionally, the roller assembly may house other active components of the appliance, such as a motor for driving a surface agitating device and/or a motor for driving wheels so that the appliance is self-propelling along the surface. In another alternative embodiment, separating apparatus can be housed inside the roller assembly, such as the cyclonic separating apparatus hereinbefore described.

Shape of Roller

Figure 18:
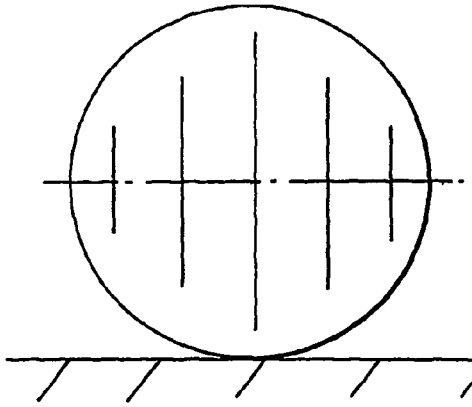
FIGS. 18-21 show alternative shapes of roller assembly.
Figure 19:
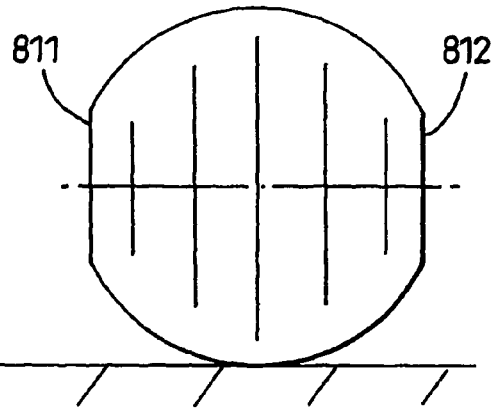

The embodiment shown in FIGS. 3-13 has a barrel shaped roller with a flat central region and tapering end regions. FIGS. 18-21 show a range of alternative roller shapes. This list is not intended to be exhaustive and other shapes, not illustrated, are intended to fall within the scope of the invention. The roller, or set of rolling members, can have a substantially spherical shape, as shown in FIG. 18, or a spherical shape with truncated faces 811, 812 as shown in FIG. 19. A true sphere has the advantage that the force required to turn the roller remains constant as the main body is turned from a straight running position, since the distance between the centre of mass and surface remains constant. Also, because the distance between the geometric centre of the roller assembly and the outer surface remains constant, the height of joint 237 between yoke 235 and the cleaner head 230 remains constant as the main body is rotated about its longitudinal axis 211. This simplifies the jointing requirements between the main body and the cleaner head 230.

Figure 20:
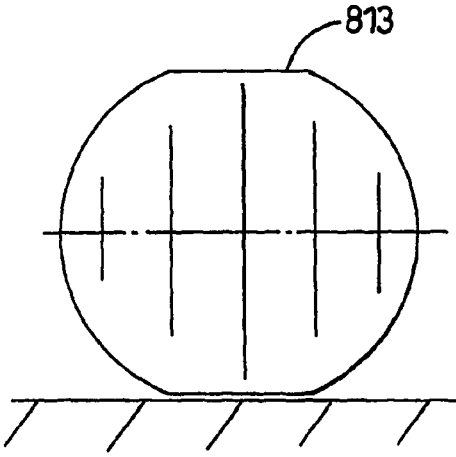
Figure 21:
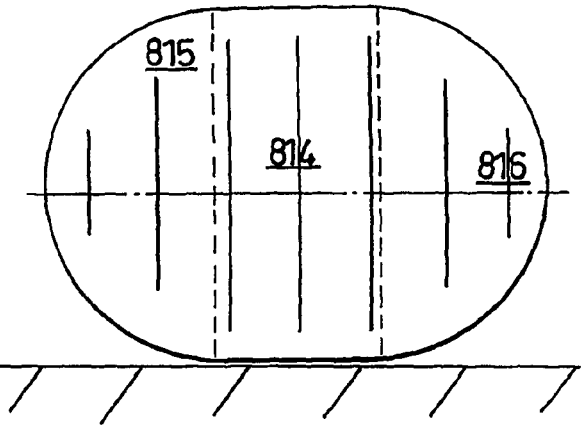

Truncating the end faces of the sphere has the benefits of reducing the width of the roller and removing a part of the surface which is not likely to be used. Also, the ducts entering and leaving the roller are likely to make contact with the floor if the machine were allowed to roll onto the outer most part of the surface. FIG. 20 shows a sphere with a central flat region 813 and FIG. 21 shows a central ring 814 of constant diameter with a hemisphere 815, 816 at each end.

Figure 23:
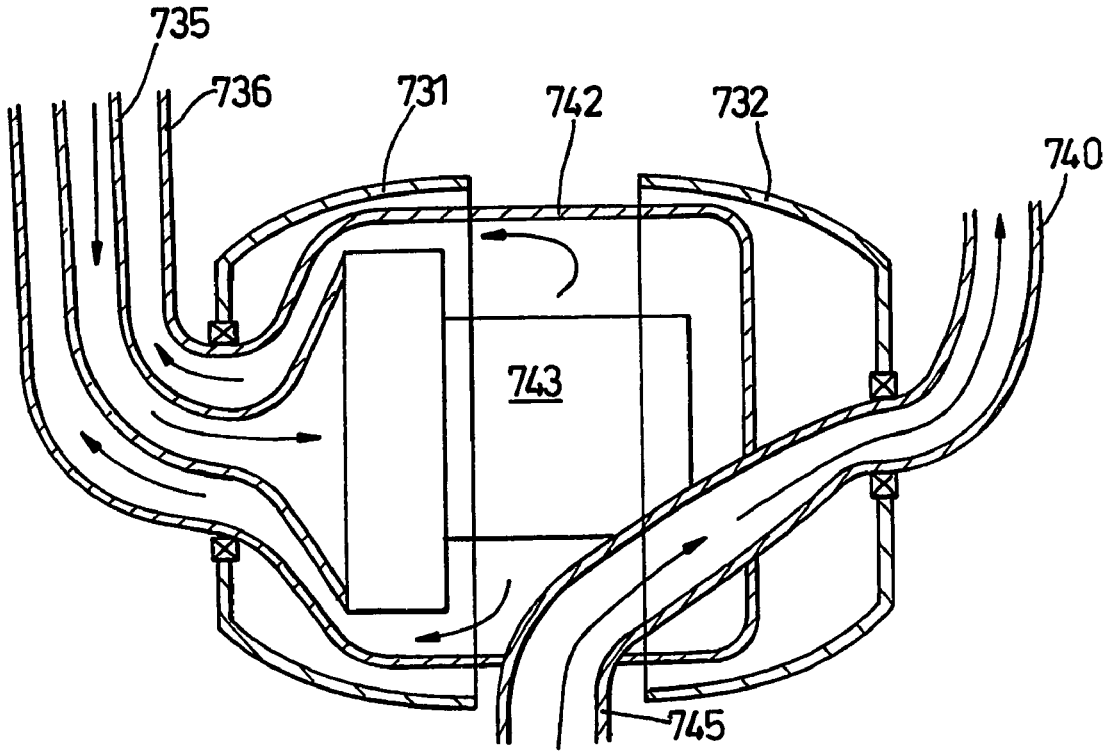
FIGS. 22-24 show a roller assembly with two rotating members.
Figure 22:
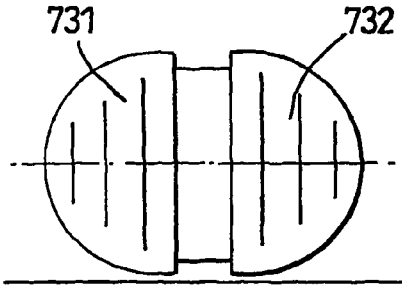
Figure 24:
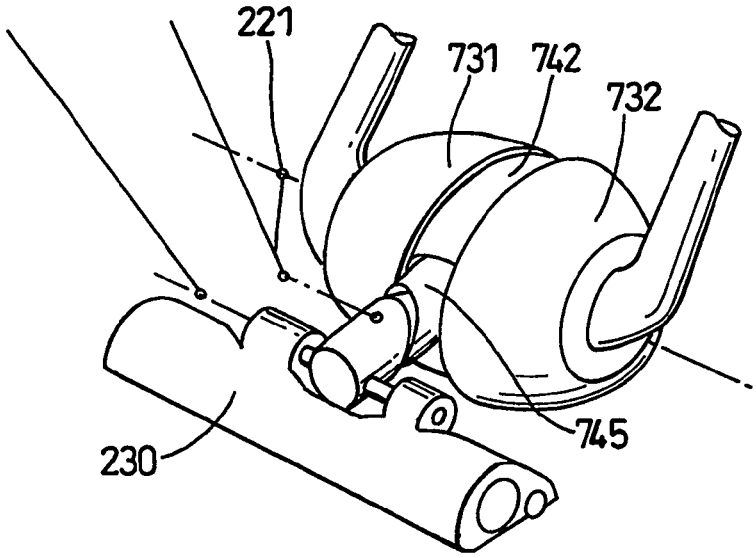

The embodiments shown above provide a roller assembly with a single rolling member. A larger number of parts can be provided. FIGS. 22-24 show embodiments where the roller assembly comprises a pair of shell-like parts 731, 732. Each part is independently rotatable. Part 731 is rotatable about a combined support arm and duct 735, 736 and part 732 is rotatable about combined duct and support arm 740. A motor bucket 742 fits within the rotatable parts 731, 732 and supports fan and motor unit 743. An advantage in providing two shell-like parts 731, 732 is that the space between parts 731, 732, in the direction along the rotational axis of the parts 731, 732, can be used to accommodate a duct 745 which carries air from the cleaner head 230 to the interior of the roller assembly, a mechanical connection between the cleaner head and the roller assembly, or both of these features. In FIGS. 23 and 24 a combined mechanical connection and air duct 741 is connected to the front of the motor bucket 742, in the space between parts 731, 732, passes inside the motor bucket 742, and then extends in a direction which is aligned with the rotational axis of part 732. Outlet duct 740 provides mechanical support for part 732 as well as carrying air flow to the main body of the vacuum cleaner. There are two ways in which the required degree of articulation between the duct 745 and main body can be achieved. Firstly, duct 745 can be pivotably mounted to the motor bucket 742. Secondly, the duct 745 can be rigidly mounted to the motor bucket 742 and the motor bucket 742 is rotatably mounted to the support arms 735, 736 and 740.

The space between the two rotatable parts 731, 732 can be used to accommodate a driving connection between a motor inside the motor bucket 742 to a brush bar on the cleaner head 230. The driving connection can be achieved by a belt and/or gears.

Figure 25:
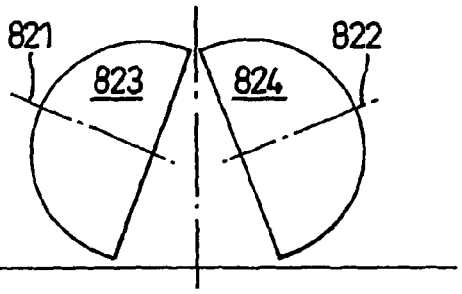
FIG. 25 shows an alternative roller assembly with two rotating members.

As shown in FIG. 25, the rotational axis of each rolling member need not be aligned with one another. Here the rotational axes 821, 822 of rolling members 823, 824 are each inclined inwardly from the vertical.

Figure 26:
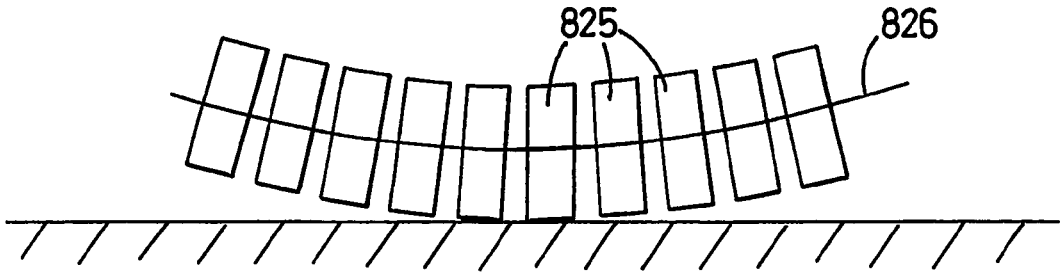
FIG. 26 shows an alternative roller assembly with a larger number of rotating members.

It is also possible to provide three or more rotatable parts. Indeed, there can be a much large number of adjacent parts which are each free to rotate about an axle as the apparatus is moved along a surface. The set of rotatable parts can all be mounted about a linear axis, with the diameter of each part decreasing with distance from the central region of the axis. Alternatively, as shown in FIG. 26, the rotatable parts 825 can all have the same or similar size and are mounted about an axis 826 which has the shape which is required from the lower surface of the roller assembly. The rotatable parts 825 can be small, solid parts which are mounted about a shaft, or they can be larger, hollow, annular parts which are rotatably mounted about a housing whose longitudinal axis is non-linear. The housing can accommodate a motor or filter, as previously described.

In each embodiment, the shape of the roller assembly, or set of rotatable parts, defines a support surface which decreases in diameter towards each end of the rotational axis so as to allow the main body to turn with ease. As in the embodiment described above, it is preferred that the central region of the rotatable part, or set of parts, is substantially flat as this has been found to increase stability of the apparatus when it is driven in a straight line.

Connection Between Main Body and the Cleaner Head

Referring again to FIGS. 6 and 7, the connection between the main body 210 and the cleaner head 230 is via a yoke 235 which has a joint 237 formed at a plane which is inclined to the longitudinal axis of arm 243. The angle of the plane 238 in which the joint lies can be varied from what is shown here. We have found that forming the joint 237 such that the plane 238 of the joint is normal with the longitudinal axis of the arm 243 is acceptable, but does not provide the full advantage of the invention since rotating the yoke does not cause arm 243 (and hence the cleaner head 230) to turn. Forming the joint 237 such that the plane 238 of the joint is inclined with the longitudinal axis of the arm 243, and substantially perpendicular to the floor surface (with the machine in a forward running position) provides good results. Inclining the plane 238 still further to what is shown in FIG. 6, or further still, increases the extent to which cleaner head 230 will move when the main body is rotated about its longitudinal axis.

The connection between arm 243 and cleaner head 230 is shown in FIGS. 6 and 7 as a true pivot with a shaft. We have found that while some degree of pivotal movement is required at this position, this movement can be achieved by a more relaxed form of jointed connection.

Figure 27:
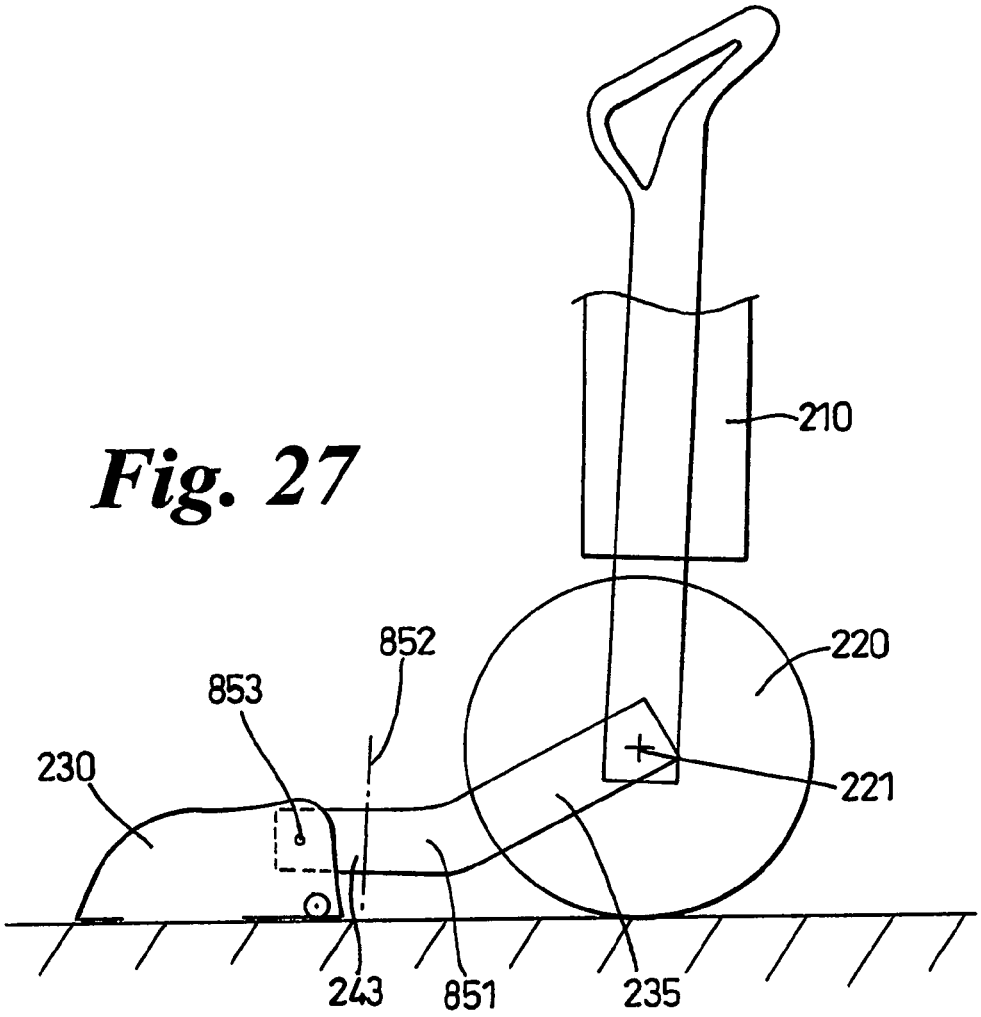
FIGS. 27 and 28 show alternative ways of connecting the main body to the cleaner head.

FIG. 27 shows an alternative form of the connection between the main body 210 and the cleaner head 230. As previously, there is a yoke 235, each end of the yoke connecting to the main body about the rotational axis 221 of the roller assembly. Also, there is a short arm 243 which is pivotably connected to the cleaner head 230. The difference is at the forward face of the yoke 235. Instead of a rotating joint which is inclined at an angle to the longitudinal axis of the arm 243, there is a rotating joint which is formed at an angle which is normal to the longitudinal axis of the arm 243 and the part of the yoke 235 which joins arm 243 at joint 852 has an elbow shape 851. The combination of an elbow shape and a joint at a normal angle has been found to be equivalent to providing a joint at an inclined angle. This alternative scheme can be more cumbersome to implement as it requires more space between the cleaner head 230 and the roller assembly 220.

Figure 29A:
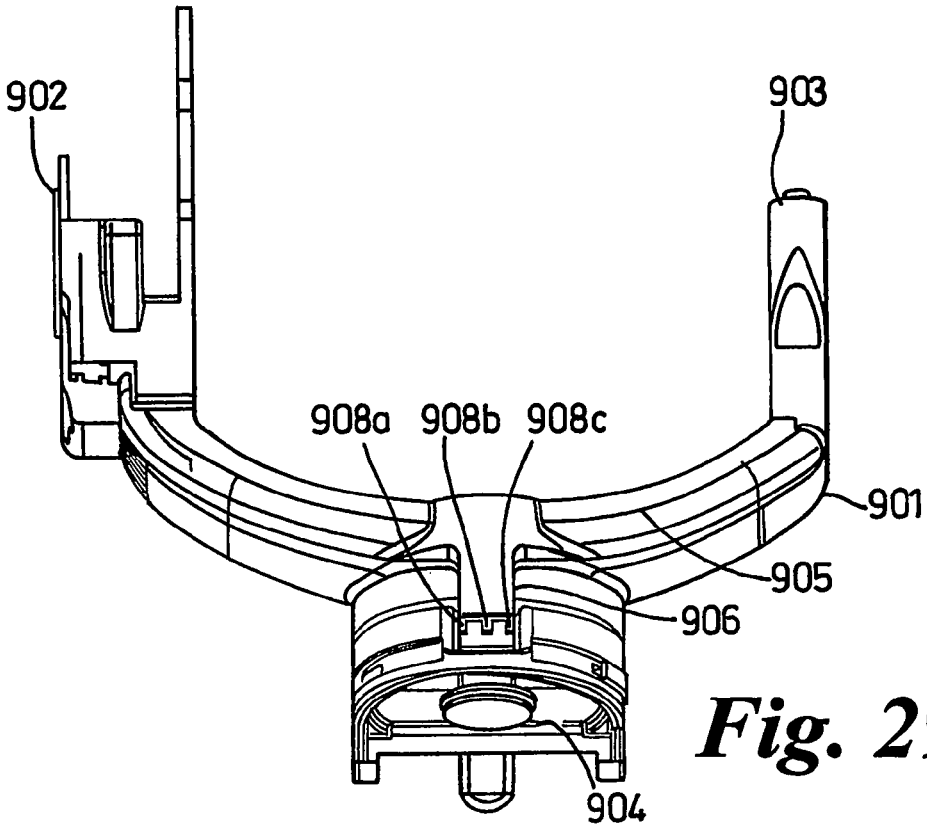
FIG. 29*a* is a front perspective view of part of a mechanism for connecting the main body to the cleaner head in a first (locked) position.
Figure 29B:
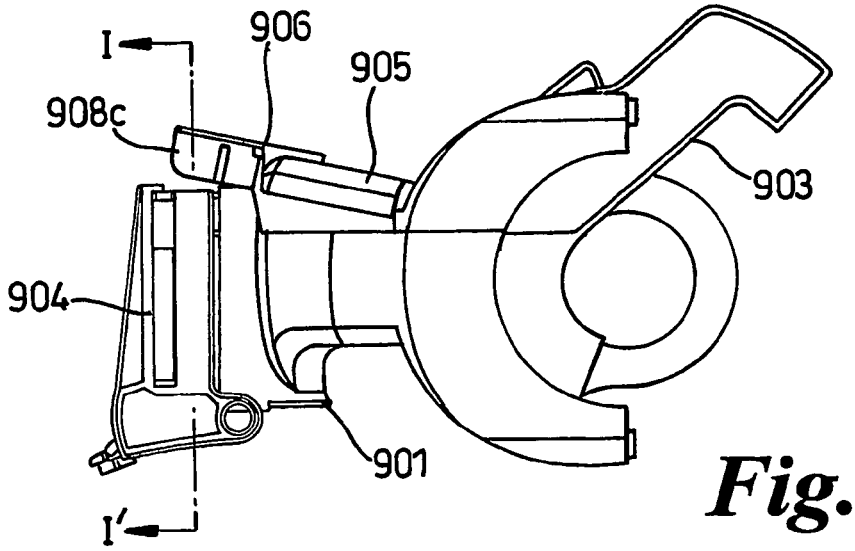
FIG. 29*b* is a side view of the mechanism of FIG. 29*a* in a second (unlocked) position.

Part of a further alternative connection between the main body and the cleaner head is illustrated in FIGS. 29*a, b* and *c*. As before, the connection comprises a yoke 901, each end portion 902, 903 of the yoke being connectable to the main body about the rotational axis of the roller assembly. The central portion of the yoke comprises a joint 904 that is connectable to a cleaner head (not shown), either directly or via an intermediate arm, such as those illustrate in FIGS. 7 and 27. The connection further comprises a locking arm 905 that is pivotably attached to the yoke 901 at the end portions 902, 903, and extends along it. The locking arm 905 has a central extending portion 906, which may be rigid with respect to the arm or may be pivotably attached to it. The central portion 906 can be received by a complementary notch arrangement 907 in the joint 904, so as to "lock" the joint and prevent it from being rotated when, for example, the appliance is in the standing position. The linkage is shown in the locked position in FIG. 29*a*. Thus, the cleaner head itself provides extra stability to the appliance in the standing position. Resilient means (not shown) may be provided to bias the central portion 906 of the locking arm 905 towards the joint when the appliance is in the standing position, so as to provide automatic locking of the joint.

Figure 29C:
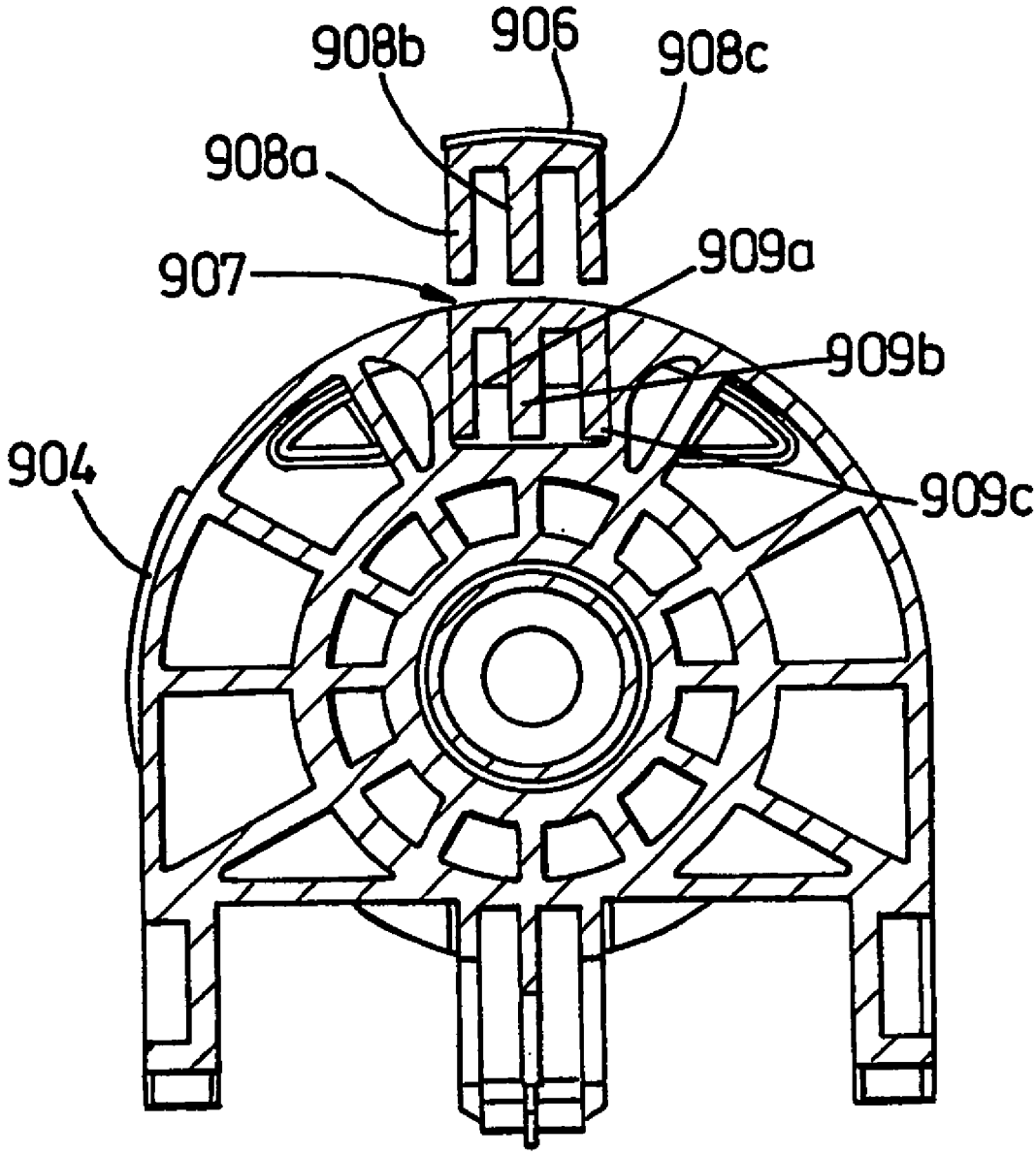
FIG. 29*c* is a front sectional view of part of the mechanism of FIG. 29*a* along the line I-I'.

When it is desired to use the appliance, the user reclines the main body of the appliance. The connection is arranged so that, when the main body is tilted backwards, the locking arm 905 rotates with respect to the yoke 901 and is raised to the extent that the central portion 906 of the locking arm is lifted out of the notch 907, thereby unlocking the joint 904 for rotation. The linkage is shown in the unlocked position in FIGS. 29*a* and 29*c*. Resilient means may be provided to assist the raising of the locking arm 905. Motion of the locking arm 905 may be influenced by motion of the stand assembly 260, 262 during reclining and righting of the appliance.

The central portion 906 of the locking arm 905 may be provided with downwardly-extending tines 908*a, b, c*, that are received by respective notches 909*a, b, c*, in the joint 904. The tines 908 are arranged to be flexible so that, if the user attempts to apply rotational force to the locked joint beyond a predetermined limit, at least one of the tines deforms. The applied force then causes the tines 908 to pop out of the notches 909, thereby freeing the joint 904 for rotation. This feature prevents the connection from being damaged in the event that excessive force is applied to the joint while the appliance is in the standing position. If the appliance is returned to the standing position, the central portion 906 of the locking arm 905 is urged back into the locked position in the joint by the force of the resilient means.

Figure 28:
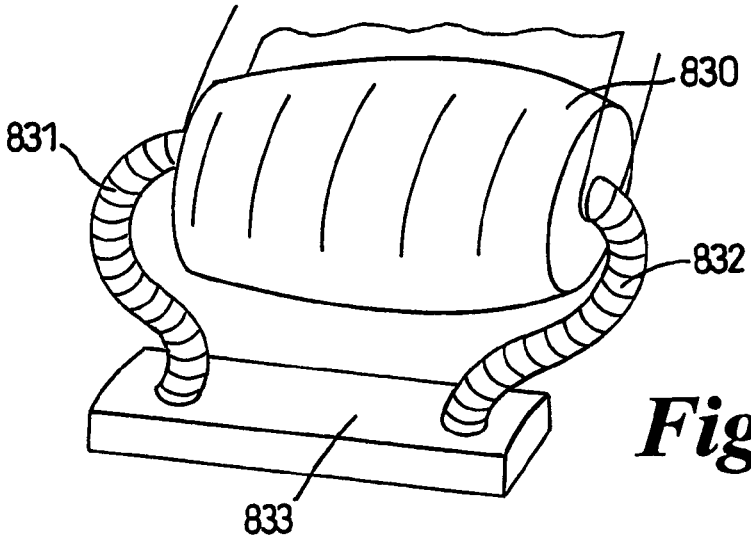

The supports between the main body and the cleaner head do not have to be rigid. FIG. 28 shows a pair of flexible support tubes 831, 832 which connect the roller assembly 830 to the cleaner head 833. Where flexible tubes are used, the cleaner head can freely remain in contact with the floor surface as the main body is rolled from side-to-side or twisted about its longitudinal axis. The use of flexible tubes in this manner avoids the need for a more complex arrangement of mechanical joints between the main body and the cleaner head.

Of course, a combination of connection mechanisms can be employed.

In each of the embodiments shown and described above airflow ducts have been used, wherever possible, to provide mechanical support between parts of the machine, e.g. between the main body 210 and roller assembly 220 and between the cleaner head 230 and main body 210 by yoke 235. This requires the ducts to be suitably sealed. It should be understood that in each embodiment where the features of a flow duct and mechanical support have been combined, separate supports and flow ducts can be substituted in their place. The flow duct can be a flexible or rigid pipe which lies alongside the mechanical support.

Although there are advantages in housing the motor inside the roller assembly, in an alternate embodiment, the fan and motor can be housed in the main body. This simplifies the ducting requirements on the machine since there only needs to be a duct from the cleaner head to the main body. Support arms are still required between the main body and the roller assembly and between the main body and the cleaner head.

While the illustrated embodiment shows a vacuum cleaner in which ducts carry airflow, it will be appreciated that the invention can be applied to vacuum cleaners which carry other fluids, such as water and detergents.

The invention claimed is:

1. A surface treating appliance comprising:

a handle having a longitudinal axis;

a surface treating head;

a support assembly which is attached to the handle and arranged to rotate with respect to the handle for allowing the appliance to be rolled along a surface; and a linkage between the handle and the surface treating head, the linkage being arranged such that rotating the support assembly and the handle about the longitudinal axis while the appliance is rolled along the surface causes the surface treating head to pivot relative to the support assembly so as to turn in a new direction while remaining substantially in contact with the surface.

2. An appliance according to claim 1 wherein the linkage is arranged to allow the surface treating head to remain substantially in contact with the surface as the handle is rotated about its longitudinal axis.

3. An appliance according to claim 1 or 2 wherein an end portion of the linkage nearer to the surface treating head comprises a pivotable connection between the linkage and the surface treating head.

4. An appliance according to claim 3 wherein the end portion of the linkage nearest the handle comprises a pivotable connection between the linkage and the handle.

5. An appliance according to claim 4 wherein the pivotable connection to the handle is substantially aligned with the rotational axis of the support assembly.

6. An appliance according to claim 5 wherein the linkage comprises a yoke, at least one end portion of which has a pivotable connection to the handle that is substantially aligned with the rotational axis of the support assembly.

7. A surface treating appliance comprising a handle having a longitudinal axis, a surface treating head, a support assembly which is attached to the handle and arranged to rotate with respect to the handle for allowing the appliance to be rolled along a surface, and a linkage between the handle and the surface treating head, the linkage being arranged such that rotating the support assembly and the handle about the longitudinal axis causes the surface treating head to turn in a new direction, wherein an end portion of the linkage nearer to the surface treating head comprises a pivotable connection between the linkage and the surface treating head, and wherein the linkage comprises a locking arm arranged to locate in a notch on the pivotable connection to the surface treating head so as to prevent rotation of the pivotable connection.

8. An appliance according to claim 7 wherein the locking arm has at least one deformable portion arranged to release from the notch when a predetermined force is applied to the pivotable connection.

9. An appliance according to claim 7 wherein the locking arm is arranged to release from the notch when the handle is tilted from an upright position.

10. An appliance according to claim 7, wherein the locking arm is biased towards the notch when the handle is in an upright position.

11. An appliance according to claim 3 wherein the linkage connects to a central part of the surface treating head.

12. An appliance according to claim 3 wherein the linkage connects to the surface treating head by means of a jointed arm, the plane of the joint lying at a non-normal angle to the longitudinal axis of the arm.

13. An appliance according to claim 3 wherein the linkage connects to the surface treating head by means of an arm which has an elbow shape and a rotatable joint.

14. An appliance according to claim 3 wherein the linkage between the handle and the surface treating head comprises at least one flexible tube.

15. An appliance according to claim 3 wherein the support assembly houses at least one component of the appliance.

16. An appliance according to claim 15 wherein the support assembly further comprises a fluid inlet for receiving fluid flow and a fluid outlet for exhausting fluid, and the component comprises a device for acting on the fluid flow received through the inlet.

17. An appliance according to claim 15 wherein the component comprises a motor for driving a further component of the appliance.

18. An appliance according to claim 3 further comprising a main body located on the handle.

19. An appliance according to claim 18 wherein the support assembly comprises one or more rotatable members having an outer surface which defines a rolling support surface in the direction perpendicular to the longitudinal axis of the handle, the support surface being symmetrical about the longitudinal axis of the handle.

20. An appliance according to claim 19 wherein the support surface extends for a distance which is at least 50% of the width of the main body.

21. An appliance according to claim 19 wherein the support surface extends for a distance which is at least 75% of the width of the main body.

22. An appliance according to claim 19 wherein the support surface extends for a distance which is substantially equal to the width of the main body.

23. An appliance according to claim 19 wherein the central region of the support assembly does not have a support surface.

24. An appliance according to claim 19 wherein the support assembly includes two rotatable members which are spaced from each other.

25. An appliance according to claim 24 wherein a component of the appliance is located between the spaced members.

26. An appliance according to claim 24 wherein a fluid inlet or outlet is located between the spaced members.

27. An appliance according to claim 3 wherein the diameter of the support assembly is less at each end portion than at the central portion.

28. An appliance according to claim 3 wherein the support assembly has at least one rotational axis which is transverse to the longitudinal axis of the handle.

29. An appliance according to claim 3 wherein the distance between the geometric centre of the assembly and the outer surface is greater at each end portion than at the central portion.

30. An appliance according to claim 3 wherein the central portion of the support assembly has a substantially constant diameter.

31. An appliance according to claim 3 wherein the support assembly is substantially spherical in shape.

32. An appliance according to claim 3 further comprising a support arm for the surface treating head which extends outwardly from the central region of the support assembly.

33. An appliance according to claim 32 wherein the support arm is a fluid flow duct for carrying fluid to/from the surface treating head.

* * * * *

UNITED STATES PATENT AND TRADEMARK OFFICE

CERTIFICATE OF CORRECTION

PATENT NO. : 7,600,292 B2
APPLICATION NO. : 10/523246
DATED : October 13, 2009
INVENTOR(S) : Courtney It is certified that error appears in the above-identified patent and that said Letters Patent is hereby corrected as shown below:

On the cover page,

Item [*] Notice: Subject to any disclaimer, the term of this patent is extended or adjusted under 35 USC 154(b) by 722 days Delete the phrase "by 722 days" and insert -- by 983 days --

Signed and Sealed this

Fifteenth Day of June, 2010

David J. Kappos

David J. Kappos
*Director of the United States Patent and Trademark Office*

US007600292C1

(12) EX PARTE REEXAMINATION CERTIFICATE (10510th)

United States Patent

Courtney

(10) Number: US 7,600,292 C1

(45) Certificate Issued: *Feb. 27, 2015

(54) SURFACE TREATING APPLIANCE

(75) Inventor: Stephen Benjamin Courtney, Bath (GB)

(73) Assignee: Dyson Technology Limited, Tetbury Hill, Malmesbury, Wiltshire (GB)

Reexamination Request:
No. 90/012,904, Jun. 28, 2013

Reexamination Certificate for:

| | |
|---|---|
| Patent No.: | **7,600,292** |
| Issued: | **Oct. 13, 2009** |
| Appl. No.: | **10/523,246** |
| PCT Filed: | **Jul. 18, 2003** |
| PCT No.: | **PCT/GB03/03142** |
| § 371 (c)(1), (2), (4) Date: | **Jan. 27, 2005** |
| PCT Pub. No.: | **WO2004/014211** |
| PCT Pub. Date: | **Feb. 19, 2004** |

Certificate of Correction issued Jun. 15, 2010

( * ) Notice: This patent is subject to a terminal disclaimer.

(30) Foreign Application Priority Data

Aug. 9, 2002 (GB) ..... 0218426.5

(51) Int. Cl.

| | |
|---|---|
| ***A47L 9/00*** | (2006.01) |
| ***A47L 5/28*** | (2006.01) |
| ***A47L 9/02*** | (2006.01) |
| ***A47L 9/24*** | (2006.01) |

(52) U.S. Cl.
CPC . *A47L 9/009* (2013.01); *A47L 5/28* (2013.01); *A47L 9/02* (2013.01); *A47L 9/0054* (2013.01); *A47L 9/242* (2013.01)

USPC ..... 15/351; 15/410

(58) Field of Classification Search
None
See application file for complete search history.

(56) References Cited

To view the complete listing of prior art documents cited during the proceeding for Reexamination Control Number 90/012,904, please refer to the USPTO's public Patent Application Information Retrieval (PAIR) system under the Display References tab.

*Primary Examiner* — Peter C English

(57) ABSTRACT

A surface treating appliance, such as a vacuum cleaner, includes a handle, a surface treating head and a support assembly. The support assembly is rollably mounted to the main body for allowing the main body to be rolled along a surface. A linkage is provided between the main body and the surface treating head and arranged such that rotating the main body about its longitudinal axis causes the surface treating head to turn in a new direction. The support assembly may house a component of the appliance, such as a motor, and may accommodate a fluid inlet for receiving fluid flow and a fluid outlet for exhausting fluid. The handle may carry the main body of the appliance.

At the time of issuance and publication of this certificate, the patent remains subject to pending reexamination control number 95/002,102 filed Aug. 24, 2012. The claim content of the patent may be subsequently revised if a reexamination certificate issues from the reexamination proceeding.

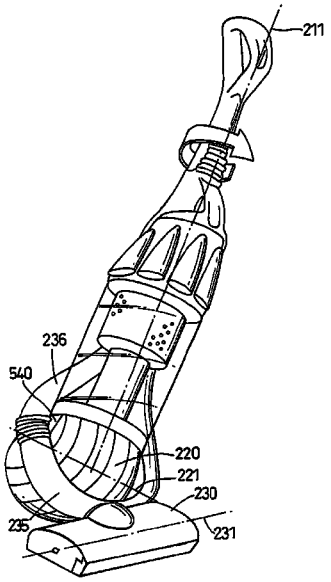

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claim 3 is determined to be patentable as amended.

Claims 12, 14, 32 and 33, dependent on an amended claim, are determined to be patentable.

New claim 34 is added and determined to be patentable.

Claims 1, 4-11, 13 and 15-31 were not reexamined.

3. An appliance according to claim 1 [or 2] wherein an end portion of the linkage nearer to the surface treating head comprises a pivotable connection between the linkage and the surface treating head.

*34. An appliance according to claim 1 wherein the linkage connects to the surface treating head by means of a joint and an arm, the joint having a plane lying at a non-normal angle to a longitudinal axis of the arm.*

* * * * *